US011378053B2

(12) United States Patent
Andersson et al.

(10) Patent No.: US 11,378,053 B2
(45) Date of Patent: Jul. 5, 2022

(54) ENGINE IGNITION CONTROL UNIT FOR IMPROVED ENGINE STARTING

(71) Applicant: Walbro LLC, Tucson, AZ (US)

(72) Inventors: Martin N. Andersson, Caro, MI (US); Cyrus M. Healy, Ubly, MI (US)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 17/270,976

(22) PCT Filed: Sep. 6, 2019

(86) PCT No.: PCT/US2019/049853
§ 371 (c)(1),
(2) Date: Feb. 24, 2021

(87) PCT Pub. No.: WO2020/055670
PCT Pub. Date: Mar. 19, 2020

(65) Prior Publication Data

US 2021/0254593 A1 Aug. 19, 2021

Related U.S. Application Data

(60) Provisional application No. 62/728,996, filed on Sep. 10, 2018.

(51) Int. Cl.
*F02P 3/06* (2006.01)
*F02P 5/14* (2006.01)
(Continued)

(52) U.S. Cl.
CPC ..... *F02P 3/06* (2013.01); *F02P 1/086* (2013.01); *F02P 3/0807* (2013.01);
(Continued)

(58) Field of Classification Search
CPC ..... F02P 3/0876; F02P 3/0884; F02P 3/0892
See application file for complete search history.

(56) References Cited

U.S. PATENT DOCUMENTS 4,204,490 A * 5/1980 Ohki ..... F02P 9/005 123/655
4,697,560 A * 10/1987 Umehara ..... F02P 9/005 123/198 DC (Continued)

FOREIGN PATENT DOCUMENTS

BR 112015005721 A2 * 7/2017 ..... F02N 3/04
CN 1690407 A 11/2005

(Continued)

OTHER PUBLICATIONS

Written Opinion & International Search Report for PCT/US2019/049853 dated Dec. 26, 2019, 13 pages.

(Continued)

*Primary Examiner* — Kevin R Steckbauer
(74) *Attorney, Agent, or Firm* — Reising Ethington P.C.; Matthew J. Schmidt

(57) ABSTRACT

In at least some implementations, a method of operating an ignition system for a combustion engine includes charging an energy storage device during at least a portion of the time when the engine is operating, permitting the level of energy stored on the charge storage device to decrease over time after the engine ceases to operate, determining the energy level on the energy storage device when the engine is restarted after having ceased operating, and setting at least one engine operational parameter as a function of the determined energy level. In at least some implementations, the at least one engine operational parameter may include one or more of: richness of a fuel and air mixture to be delivered to the engine, ignition timing, desired engine idle speed.

13 Claims, 2 Drawing Sheets

(51) Int. Cl.
*F02P 5/15* (2006.01)
*F02P 3/08* (2006.01)
*F02P 1/08* (2006.01)

(52) U.S. Cl.
CPC ..... *F02P 3/0815* (2013.01); *F02P 3/0838* (2013.01); *F02P 3/0846* (2013.01); *F02P 3/0876* (2013.01); *F02P 3/0884* (2013.01); *F02P 3/0892* (2013.01); *F02P 5/14* (2013.01); *F02P 5/1506* (2013.01)

(56) References Cited

U.S. PATENT DOCUMENTS

| | | | | | |
|---|---|---|---|---|---|
| 4,893,605 | A * | 1/1990 | Ozawa | F02P 3/0556 | 123/632 |
| 5,318,002 | A * | 6/1994 | Okuda | F02P 3/0861 | 123/598 |
| 5,433,184 | A * | 7/1995 | Kinoshita | F02P 15/08 | 123/406.57 |
| 6,584,965 | B1 * | 7/2003 | Ward | F02P 3/0884 | 123/620 |
| 6,932,064 | B1 | 8/2005 | Kolak et al. | | |
| 6,948,484 | B2 * | 9/2005 | Umino | F02P 17/00 | 123/597 |
| 7,448,358 | B2 * | 11/2008 | Andersson | F02P 5/1504 | 123/399 |
| 7,546,836 | B2 * | 6/2009 | Andersson | F02P 3/0815 | 123/406.56 |
| 7,706,960 | B2 * | 4/2010 | Nishida | F02P 11/00 | 701/112 |
| 9,556,846 | B2 * | 1/2017 | Straka | F02P 11/025 | |
| 10,066,592 | B2 * | 9/2018 | Andersson | F02P 5/1502 | |
| 10,626,839 | B2 | 4/2020 | Andersson et al. | | |
| 11,149,678 | B2 * | 10/2021 | Ayuzawa | F02P 3/0442 | |
| 2005/0066948 | A1 * | 3/2005 | Umino | F02P 3/0807 | 123/597 |
| 2014/0251271 | A1 * | 9/2014 | Straka | F02P 11/025 | 123/406.12 |
| 2016/0076506 | A1 * | 3/2016 | Andersson | F02P 3/04 | 123/634 |
| 2021/0254593 | A1 * | 8/2021 | Andersson | F02P 5/1506 | |

FOREIGN PATENT DOCUMENTS

| | | | | | |
|---|---|---|---|---|---|
| CN | 104662286 | A * | 5/2015 | F02N 3/04 | |
| CN | 105164403 | A | 12/2015 | | |
| CN | 104662286 | B * | 11/2017 | F02N 3/04 | |
| JP | 2005098235 | A * | 4/2005 | F02P 17/00 | |
| JP | 2008267319 | A | 11/2008 | | |
| JP | 6069337 | B2 * | 2/2017 | F02N 3/04 | |
| MX | 347129 | B * | 4/2017 | F02N 3/04 | |
| WO | WO-2014050182 | A1 * | 4/2014 | F02N 3/04 | |
| WO | WO2014050182 | A1 | 4/2014 | | |
| WO | WO2017015420 | A1 | 1/2017 | | |
| WO | WO2017185017 | A1 | 10/2017 | | |

OTHER PUBLICATIONS

CN Office Action for CN Application No. 201980058757.7 dated Mar. 23, 2022 (13 pages).

* cited by examiner

ENGINE IGNITION CONTROL UNIT FOR IMPROVED ENGINE STARTING

REFERENCE TO RELATED APPLICATIONS

This application claims the benefit of U.S. Provisional Application Ser. No. 62/728,996 filed on Sep. 10, 2018 the entire contents of which are incorporated herein by reference in its entirety.

TECHNICAL FIELD

The present disclosure relates generally to an engine ignition control unit for a combustion engine.

BACKGROUND

Capacitor discharge ignition (CDI) systems are widely used in spark-ignited internal combustion engines. Generally, CDI systems include a main capacitor that is charged by an associated generator or charge coil and is later discharged through a step-up transformer or ignition coil to fire a spark plug. CDI systems typically have a stator assembly and one or more magnets are typically mounted on an engine flywheel to generate current pulses within the charge coil as the magnets are rotated past the stator. The current pulses produced in the charge coil are used to charge the main capacitor which is subsequently discharged upon activation of a trigger signal. A microprocessor has inputs and outputs and is coupled to the ignition circuit by multiple wires which each separately provide signals to and from the microprocessor to control operation of the ignition system in accordance with various factors such as engine speed and desired ignition timing.

SUMMARY

In at least some implementations, a method of operating an ignition system for a combustion engine includes charging an energy storage device during at least a portion of the time when the engine is operating, permitting the level of energy stored on the charge storage device to decrease over time after the engine ceases to operate, determining the energy level on the energy storage device when the engine is restarted after having ceased operating, and setting at least one engine operational parameter as a function of the determined energy level. In at least some implementations, the at least one engine operational parameter may include one or more of: richness of a fuel and air mixture to be delivered to the engine, ignition timing, desired engine idle speed.

In at least some implementations, a switch is provided that has a first state in which charging of the energy storage device is not permitted and a second state in which charging of the energy storage device is permitted, and the switch is in the first state absent power being supplied to the switch, and the method includes the step of providing power to the switch when the engine is operating so that the switch is in the second state and charging of the energy storage device is permitted. In at least some implementations, power is not provided to the switch until the engine has been operating for a threshold time or threshold number of engine revolutions. In at least some implementations, power is not provided to the switch until the energy level on the energy storage device, when the engine is restarted after having ceased operating, has been determined.

In at least some implementations, the method also includes comparing the energy level on the energy storage device when the engine is restarted after having ceased operating with information relating to the rate at which energy in the energy storage device decays over time. When the energy level in the energy storage device corresponds to the engine having been not operating for between 5 minutes and 45 minutes, at least one of richness of a fuel and air mixture to be delivered to the engine, ignition timing, and desired engine idle speed is set to a level equal to such level used when starting a cold engine. The energy level that corresponds to the engine having been not operating for between 5 minutes and 45 minutes may be indirectly measured as zero volts or more than zero volts.

In at least some implementations, the method may include determining one or both of engine temperature and ambient temperature and wherein the at least one engine operational parameter is set based in part on one or both of the determined engine temperature and ambient temperature. One or both of the engine temperature and ambient temperature may be determined upon attempted restarting of the engine or when the engine has been restarted.

In at least some implementations, an engine control system includes a main energy storage device adapted to be communicated with an energy source, an ignition switch coupled to the main energy storage device to control discharge of energy from the main energy storage device, and a timing circuit including a second energy storage device, a second switch coupled to the second energy storage device and having a first state permitting current flow to the second energy storage device and a second state that does not permit current flow to the second energy storage device.

In at least some implementations, the system includes one or more resistors coupled between the second switch and the second energy storage device to at least in part control the discharge rate of energy from the second energy storage device. In at least some implementations, a controller is coupled to the second switch and to the second energy storage device, and the controller is operable to control the state of the switch and to determine an energy level of the second energy storage device. In at least some implementations, the main energy storage device is a capacitor of a capacitive ignition discharge circuit. And in at least some implementations, the second energy storage device is coupled to ground and energy discharged from the second energy storage device is discharged to ground.

BRIEF DESCRIPTION OF THE DRAWINGS

The following detailed description of certain embodiments and best mode will be set forth with reference to the accompanying drawings, in which.

DETAILED DESCRIPTION

The methods and systems described herein generally relate to combustion engines that include ignition systems with microcontroller circuitry, including but not limited to light-duty combustion engines. Typically, the light-duty combustion engine is a single cylinder two-stroke or four-stroke gasoline powered internal combustion engine. A piston is slidably received for reciprocation in an engine cylinder and is connected to a crank shaft that, in turn, is attached to a fly wheel. Such engines are often paired with a capacitive discharge ignition (CDI) system that utilizes a microcontroller to supply a high voltage ignition pulse to a spark plug for igniting an air-fuel mixture in the engine combustion chamber. The term "light-duty combustion engine" broadly includes all types of non-automotive combustion engines, including two and four-stroke engines typically used to power devices such as gasoline-powered hand-held power tools, lawn and garden equipment, lawnmowers, weed trimmers, edgers, chain saws, snowblowers, personal watercraft, boats, snowmobiles, motorcycles, all-terrain-vehicles, etc. It should be appreciated that while the following description is in the context of a capacitive discharge ignition (CDI) system, the control circuit and/or the power supply sub-circuit described herein may be used with any number of different ignition systems and are not limited to the particular one shown here. Further, while generally described with reference to a light-duty combustion engine, the methods and components described herein may be used with other types of engines including multi-cylinder engines, engines for automotive applications and other larger engines.

Figure 1:
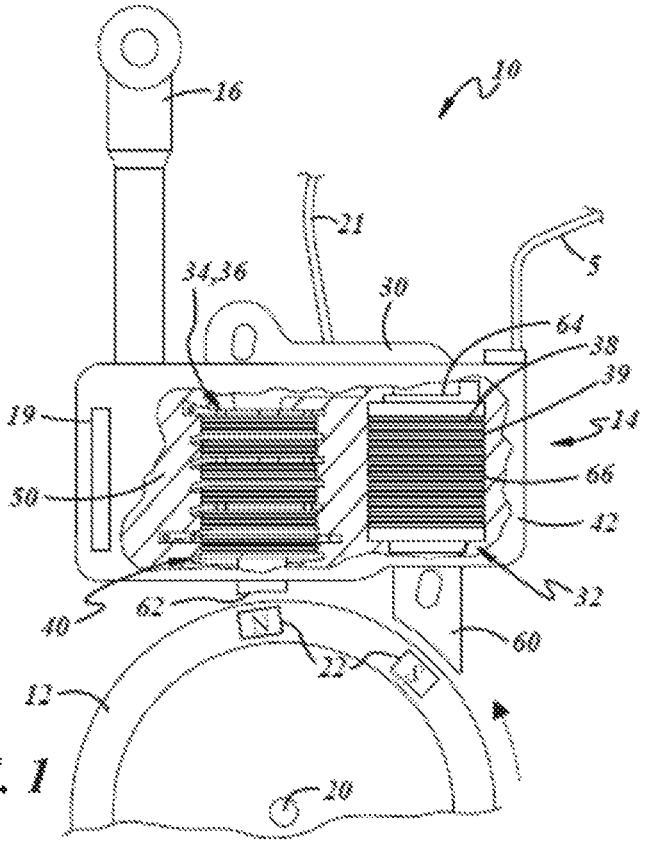
FIG. 1 shows an example of a capacitor discharge ignition (CDI) system for a light-duty combustion engine.

With reference to FIG. 1, there is shown a cut-away view of an exemplary capacitive discharge ignition (CDI) system 10 that interacts with a flywheel 12 and generally includes an ignition module 14, an ignition lead 16 for electrically coupling the ignition module to a spark plug SP (shown in FIG. 2), and electrical connections 5, 21 for coupling the ignition module to one or more auxiliary loads, such as a carburetor solenoid valve. The flywheel 12 shown here includes a pair of magnetic poles or elements 22 located towards an outer periphery of the flywheel. Once flywheel 12 is rotating, magnetic elements 22 spin past and electromagnetically interact with the different coils or windings in ignition module 14.

Ignition module 14 can generate, store, and utilize the electrical energy that is induced by the rotating magnetic elements 22 in order to perform a variety of functions. According to one embodiment, ignition module 14 includes a lamstack 30, a charge winding 32, a primary winding 34 and a secondary winding 36 that together constitute a step-up transformer, a first auxiliary winding 38, a second auxiliary winding 39, a trigger winding 40, an ignition module housing 42, and a control circuit 50. Lamstack 30 is preferably a ferromagnetic part that is comprised of a stack of flat, magnetically-permeable, laminate pieces typically made of steel or iron. The lamstack can assist in concentrating or focusing the changing magnetic flux created by the rotating magnetic elements 22 on the flywheel. According to the embodiment shown here, lamstack 30 has a generally U-shaped configuration that includes a pair of legs 60 and 62. Leg 60 is aligned along the central axis of charge winding 32, and leg 62 is aligned along the central axes of trigger winding 40 and the step-up transformer. The first auxiliary winding 38, second auxiliary winding 39 and trigger winding 40 are shown on leg 60, however, these windings or coils could be located elsewhere on the lamstack 30. Magnetic elements 22 can be implemented as part of the same magnet or as separate magnetic components coupled together to provide a single flux path through flywheel 12, to cite two of many possibilities. Additional magnetic elements can be added to flywheel 12 at other locations around its periphery to provide additional electromagnetic interaction with ignition module 14.

Charge winding 32 generates electrical energy that can be used by ignition module 14 for a number of different purposes, including charging an ignition capacitor and powering an electronic processing device, to cite two of many examples. Charge winding 32 includes a bobbin 64 and a winding 66 and, according to one embodiment, is designed to have a relatively low inductance and a relatively low resistance, but this is not necessary.

Trigger winding 40 provides ignition module 14 with an engine input signal that is generally representative of the position and/or speed of the engine. According to the particular embodiment shown here, trigger winding 40 is located towards the end of lamstack leg 62 and is adjacent to the step-up transformer. It could, however, be arranged at a different location on the lamstack. For example, it is possible to arrange both the trigger and charge windings on a single leg of the lamstack, as opposed to arrangement shown here. It is also possible for trigger winding 40 to be omitted and for ignition module 14 to receive an engine input signal from charge winding 32 or some other device.

Step-up transformer uses a pair of closely-coupled windings 34, 36 to create high voltage ignition pulses that are sent to a spark plug SP via ignition lead 16. Like the charge and trigger windings described above, the primary and secondary windings 34, 36 surround one of the legs of lamstack 30, in this case leg 62. The primary winding 34 has fewer turns of wire than the secondary winding 36, which has more turns of finer gauge wire. The turn ratio between the primary and secondary windings, as well as other characteristics of the transformer, affect the voltage and are typically selected based on the particular application in which it is used.

Ignition module housing 42 is preferably made from a plastic, metal, or some other material, and is designed to surround and protect the components of ignition module 14. The ignition module housing has several openings to allow lamstack legs 60 and 62, ignition lead 16, and electrical connections 5, 21 to protrude, and preferably are sealed so that moisture and other contaminants are prevented from damaging the ignition module. It should be appreciated that ignition system 10 is just one example of a capacitive discharge ignition (CDI) system that can utilize ignition module 14, and that numerous other ignition systems and components, in addition to those shown here, could also be used as well.

Control circuit 50 may be carried within the housing 42 or within a housing remote from the flywheel and lamstack and communicated with the ignition module 14 to receive energy from the module 14 and to control, at least in part, operation of the module. For example, a control module may be located on or adjacent to a throttle body, such as is shown and described in PCT patent application Ser. No. 17/028,913 filed Apr. 21, 2017 the disclosure of which is incorporated herein by reference in its entirety. Such a module may be responsive to a throttle valve position and/or other variables to control ignition timing, a fuel/air mixture content (such as by varying the amount of fuel or air with a valve), whether to cause an ignition event in a given engine cycle, engine speed control, among other things. The module could be located remotely from the engine and any throttle body, carburetor or other component associated with the engine, for example, in a handle, housing, cowling or other component of a vehicle or device that includes the engine. The control module may be coupled to portions of the ignition module 14 so that it can control, if desired, the energy that is induced, stored and discharged by the ignition system 10. The term "coupled" broadly encompasses all ways in which two or more electrical components, devices, circuits, etc. can be in electrical communication with one another; this includes but is certainly not limited to, a direct electrical connection and a connection via intermediate components, devices, circuits, etc. The control circuit 50 may be provided according to the exemplary embodiment shown in FIG. 2 where the control circuit is coupled to and interacts with charge winding 32, primary ignition winding 34, first auxiliary winding 38, second auxiliary winding 39, and trigger winding 40. According to this particular example, the control circuit 50 includes an ignition discharge capacitor 52, an ignition discharge switch 54, a microcontroller 56, a power supply sub-circuit 58, as well as any number of other electrical elements, components, devices and/or sub-circuits that may be used with the control circuit and are known in the art (e.g., kill switches and kill switch circuitry).

The ignition discharge capacitor 52 acts as a main energy storage device for the ignition system 10. According to the embodiment shown in FIG. 2, the ignition discharge capacitor 52 is coupled to the charge winding 32 and the ignition discharge switch 54 at a first terminal, and is coupled to the primary winding 34 at a second terminal. The ignition discharge capacitor 52 is configured to receive and store electrical energy from the charge winding 32 via diode 70 and to discharge the stored electrical energy through a path that includes the ignition discharge switch 54 and the primary winding 34. Discharge of the electrical energy stored on the ignition discharge capacitor 52 is controlled by the state of the ignition discharge switch 54, as is widely understood in the art. As these components are coupled to one or more coils in the ignition module 14, these components may, if desired, be located within the ignition module on a circuit board 19 or otherwise arranged.

The ignition discharge switch 54 acts as a main switching device for the ignition system 10. The ignition discharge switch 54 is coupled to the ignition discharge capacitor 52 at a first current carrying terminal, to ground at a second current carrying terminal, and to an output of the microcontroller 56 at its gate. As noted herein, the microcontroller 56 may be located remotely, if desired, which is to say not within the ignition module 14. The ignition discharge switch 54 can be provided as a thyristor, for example, a silicon controller rectifier (SCR). An ignition trigger signal from an output of the microcontroller 56 activates the ignition discharge switch 54 so that the ignition discharge capacitor 52 can discharge its stored energy through the switch and thereby create a corresponding ignition pulse in the ignition coil.

The microcontroller 56 is an electronic processing device that executes electronic instructions in order to carry out functions pertaining to the operation of the light-duty combustion engine. This may include, for example, electronic instructions used to implement the methods described herein. In one example, the microcontroller 56 includes the 8-pin processor illustrated in FIG. 2, however, any other suitable controller, microcontroller, microprocessor and/or other electronic processing device may be used instead. Pins 1 and 8 are coupled to the power supply sub-circuit 58, which provides the microcontroller with power that is somewhat regulated; pins 2 and 7 are coupled to trigger winding 40 and provide the microcontroller with an engine signal that is representative of the speed and/or position of the engine (e.g., position relative to top-dead-center); pins 3 and 5 are shown as being connected to a timing sub-circuit which will be described in more detail below; pin 4 is coupled to ground; and pin 6 is coupled to the gate of ignition discharge switch 54 so that the microcontroller can provide an ignition trigger signal, sometimes called a timing signal, for activating the switch. Some non-limiting examples of how microcontrollers can be implemented with ignition systems are provided in U.S. Pat. Nos. 7,546,836 and 7,448,358, the entire contents of which are hereby incorporated by reference.

The power supply sub-circuit 58 receives electrical energy from the charge winding 32, stores the electrical energy, and provides the microcontroller 56 with regulated, or at least somewhat regulated, electrical power. The power supply sub-circuit 58 is coupled to the charge winding 32 at an input terminal 80 and to the microcontroller 56 at an output terminal 82 and, according to the example shown in FIG. 2, includes a first power supply switch 90, a power supply capacitor 92, a power supply zener 94, a second power supply switch 96, and one or more power supply resistors 98. As will be explained below in more detail, the power supply sub-circuit 58 is designed and configured to reduce the portion of the charge winding load that is attributable to powering the microcontroller 56, or other electrically powered devices, like a solenoid or the like. The components of the power supply sub-circuit 58 may be located in the ignition module, the control module that is separate from the ignition module, or a combination of the two, as desired.

The first power supply switch 90, which can be any suitable type of switching device like a BJT or MOSFET, is coupled to the charge winding 32 at a first current carrying terminal, to the power supply capacitor 92 at a second current carrying terminal, and to the second power supply switch 96 at a base or gate terminal. When the first power supply switch 90 is activated or is in an 'on' state, current is allowed to flow from the charge winding 32 to the power supply capacitor 92; when the switch 90 is deactivated or is in an 'off' state, current is prevented from flowing from the charge winding 32 to the capacitor 92. As mentioned above, any suitable type of switching device may be used for the first power supply switch 90, but such a device should be able to handle a significant amount of voltage; for example between about 150 V and 450 V.

The power supply capacitor 92 is coupled to the first power supply switch 90, the power supply zener 94 and the microcontroller 56 at a positive terminal, and is coupled to ground at a negative terminal. The power supply capacitor 92 receives and stores electrical energy from the charge winding 32 so that it may power the microcontroller 56 in a somewhat regulated and consistent manner.

The power supply zener 94 is coupled to the power supply capacitor 92 at a cathode terminal and is coupled to second power supply switch 96 at an anode terminal. The power supply zener 94 is arranged to be non-conductive so as long as the voltage on the power supply capacitor 92 is less than the breakdown voltage of the zener diode and to be conductive when the capacitor voltage exceeds the breakdown voltage. A zener diode with a particular breakdown voltage may be selected based on the amount of electrical energy that is deemed necessary for the power supply sub-circuit 58 to properly power the microcontroller 56. Any zener diode or other similar device may be used, including zener diodes having a breakdown voltage between about 3V and 20V.

The second power supply switch 96 is coupled to resistor 98 and the base of the first power supply switch 90 at a first current carrying terminal, to ground at a second current carrying terminal, and to the power supply zener diode 94 at a gate. As will be described below in more detail, the second power supply switch 96 is arranged so that when the voltage at the zener diode 94 is less than its breakdown voltage, the second power supply switch 96 is held in a deactivated or 'off' state; when the voltage at the zener diode exceeds the breakdown voltage, then the voltage at the gate of the second power supply switch 96 increases and activates that device so that it turns 'on'. Again, any number of different types of switching devices may be used, including thyristors in the form of silicon controller rectifiers (SCRs). According to one non-limiting example, the second power supply switch is an SCR and has a gate current rate between about 2 μA and 3 mA.

The power supply resistor 98 is coupled at one terminal to charge winding 32 and one of the current carrying terminals of the first power supply switch 90, and at another terminal to one of the current carrying terminals of the second power supply switch 96. It is preferable that power supply resistor 98 have a sufficiently high resistance so that a high-resistance, low-current path is established through the resistor when the second power supply switch 96 is turned 'on'. In one example, the power supply resistor 98 has a resistance between about 5 kΩ and 10 kΩ, however, other values may certainly be used instead.

Figure 2:
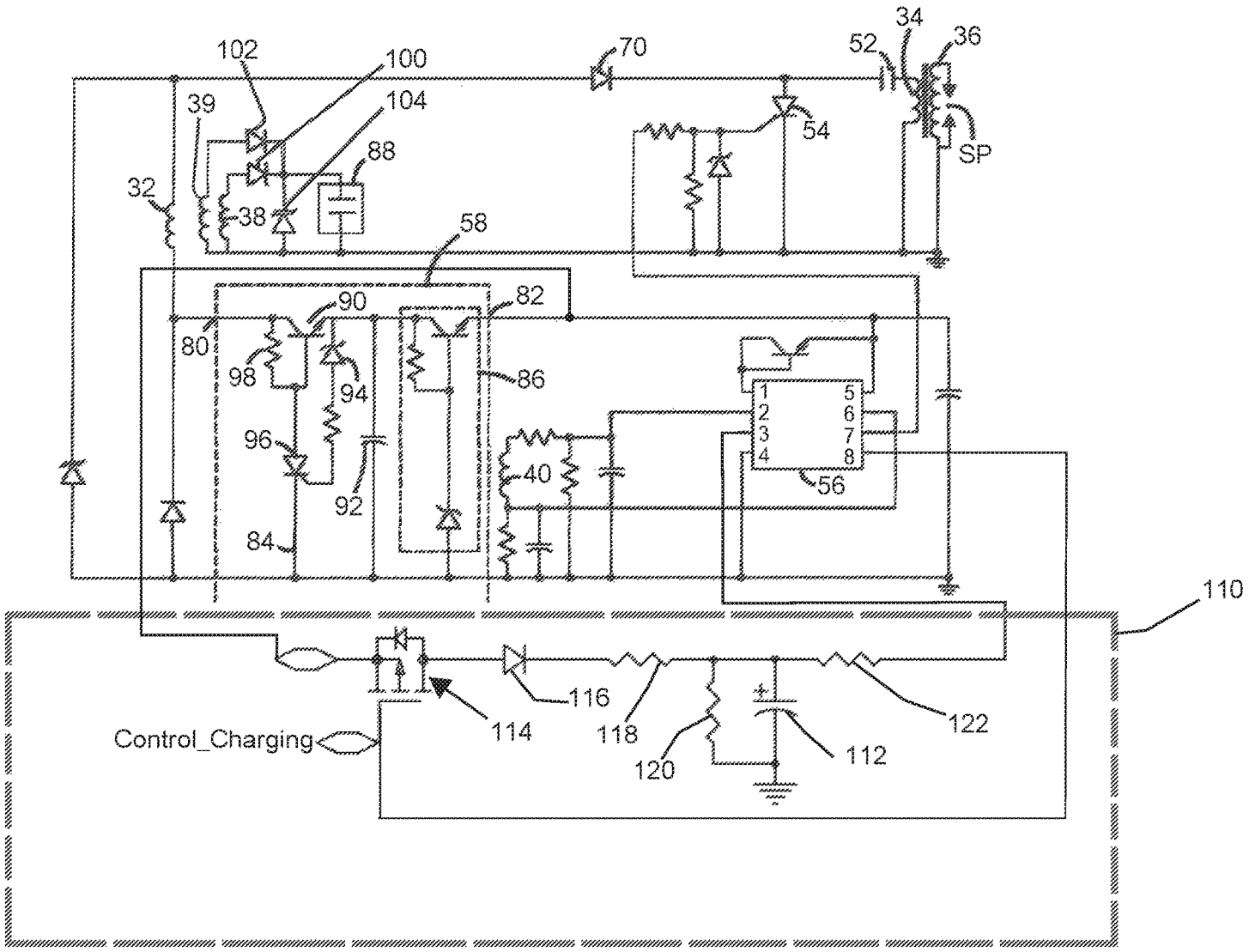
FIG. 2 is a schematic diagram of a circuit that may be used with the CDI system of FIG. 1.

During a charging cycle, electrical energy induced in the charge winding 32 may be used to charge, drive and/or otherwise power one or more devices around the engine. For example, as the flywheel 12 rotates past the ignition module 14, the magnetic elements 22 carried by the flywheel induce an AC voltage in the charge winding 32. A positive component of the AC voltage may be used to charge the ignition discharge capacitor 52, while a negative component of the AC voltage may be provided to the power supply sub-circuit 58 which then powers the microcontroller 56 with regulated DC power. The power supply sub-circuit 58 may be designed to limit or reduce the amount of electrical energy taken from the negative component of the AC voltage to a level that is still able to sufficiently power the microcontroller 56, yet saves energy for use elsewhere in the system, for example to drive a fuel injector in an electronic fuel injection system. Another example of a device that may benefit from this energy savings is a solenoid that is coupled to the windings 38 and 39 and is used to control the air/fuel ratio being provided to the combustion chamber. The power supply sub-circuit may be constructed and arranged as shown in FIG. 2 and as described in PCT Application Publication WO 2017/015420.

Beginning with the positive portion of the AC voltage that is induced in the charge winding 32, current flows through diode 70 and charges ignition discharge capacitor 52. So long as the microcontroller 56 holds the ignition discharge switch 54 in an 'off' state, the current from the charge winding 32 is directed to the ignition discharge capacitor 52. It is possible for the ignition discharge capacitor 52 to be charged throughout the entire positive portion of the AC voltage waveform, or at least for most of it. When it is time for the ignition system 10 to fire the spark plug SP (i.e., the ignition timing), the microcontroller 56 sends an ignition trigger signal to the ignition discharge switch 54 that turns the switch 'on' and creates a current path that includes the ignition discharge capacitor 52 and the primary ignition winding 34. The electrical energy stored on the ignition discharge capacitor 52 rapidly discharges via the current path, which causes a surge in current through the primary ignition winding 34 and creates a fast-rising electro-magnetic field in the ignition coil. The fast-rising electromagnetic field induces a high voltage ignition pulse in the secondary ignition winding 36 that travels to the spark plug SP and provides a combustion-initiating spark. Other sparking techniques, including flyback techniques, may be used instead.

Turning now to the negative component or portion of the AC voltage that is induced in the charge winding 32, current initially flows through the first power supply switch 90 and charges power supply capacitor 92. So long as second power supply switch 96 is turned 'off', there is current flow through power supply resistor 98 so that the voltage at the base of the first power supply switch 90 biases the switch in an 'on' state. Charging of the power supply capacitor 92 continues until a certain charge threshold is met; that is, until the accumulated charge on capacitor 92 exceeds the breakdown voltage of the power supply zener 94. As mentioned above, zener diode 94 is preferably selected to have a certain breakdown voltage that corresponds to a desired charge level for the power supply sub-circuit 58. Some initial testing has indicated that a breakdown voltage of approximately 6 V may be suitable in some light-duty engine applications, although other values may be used. The power supply capacitor 92 uses the accumulated charge to provide the microcontroller 56 with regulated DC power. Of course, additional circuitry like the secondary stage circuitry 86 may be employed for reducing ripples and/or further filtering, smoothing and/or otherwise regulating the DC power.

Once the stored charge on the power supply capacitor 92 exceeds the breakdown voltage of the power supply zener 94, the zener diode becomes conductive in the reverse bias direction so that the voltage seen at the gate of the second power supply switch 96 increases. This turns the second power supply switch 96 'on', which creates a low current path 84 that flows through resistor 98 and switch 96 and lowers the voltage at the base of the first power supply switch 90 to a point where it turns that switch 'off'. With first power supply switch 90 deactivated or in an 'off' state, additional charging of the power supply capacitor 92 is prevented. Moreover, power supply resistor 98 preferably exhibits a relatively high resistance so that the amount of current that flows through the low current path 84 during this period of the negative portion of the AC cycle is minimal (e.g., on the order of 50 μA) and, thus, limits the amount of wasted electrical energy. The first power supply switch 90 will remain 'off' until the microcontroller 56 pulls enough electrical energy from power supply capacitor 92 to drop its voltage below the breakdown voltage of the power supply zener 94, at which time the second power supply switch 96 turns 'off' so that the cycle can repeat itself. This arrangement may somewhat simulate a low cost hysteresis approach.

Accordingly, instead of charging the power supply capacitor 92 during the entire negative portion of the AC voltage waveform, the power supply sub-circuit 58 only charges capacitor 92 for a first segment of the negative portion of the AC voltage waveform; during a second segment, the capacitor 92 is not being charged. Put differently, the power supply sub-circuit 58 only charges the power supply capacitor 92 until a certain charge threshold is reached, after which additional charging of capacitor 92 is cut off. Because less electrical current is flowing from the charge winding 32 to the power supply sub-circuit 58, the electromagnetic load on the winding and/or the circuit is reduced, thereby making more electrical energy available for other windings and/or other devices. If the electrical energy in the ignition system 10 is managed efficiently, it may possible for the system to support both an ignition load and external loads (e.g., an air/fuel ratio regulating solenoid) on the same magnetic circuit.

This arrangement and approach is different than simply utilizing a simple current limiting circuit to clip the amount of current that is allowed into the power supply sub-circuit 58 at any given time. Such an approach may result in undesirable effects, in that it may be slow to reach a working voltage due to the limited current available, thus, causing unwanted delays in the functionality of the ignition system. The power supply sub-circuit 58 is designed to allow higher amounts of current to quickly flow into the power supply capacitor 92, which charges the power supply more rapidly and brings it to a sufficient DC operating level in a shorter amount of time than is experienced with a simple current limiting circuit.

As mentioned above, the electrical energy that is saved or not used by power supply sub-circuit 58 may be applied to any number of different devices around the engine. One example of such a device is a solenoid that controls the air/fuel ratio of the gas mixture supplied from a carburetor to a combustion chamber. Referring back to FIG. 2, the first auxiliary winding 38 and the second auxiliary winding 39 could be coupled to a device 88, such as a solenoid, an additional microcontroller or any other device requiring electrical energy. The first and second auxiliary windings 38 and 39 may be connected in parallel with each other and may each have one terminal coupled to the solenoid via intervening diodes 100 and 102, respectively and their other terminals coupled to ground. A zener diode 104 may be connected in parallel between the solenoid and coils 38 and 39 to protect the solenoid from a voltage greater than the zener diode breakdown voltage (excess current flows through the zener diode to ground).

Because the magnets 22 are fixed to the flywheel 12, the position of the magnets relative to one or more coils of the ignition circuit may be used to determine the position of the flywheel and thus, the position of the crankshaft and piston. This information may also be used to determine the engine speed (e.g. the time from a certain engine position in one revolution to the same engine position in the next revolution may be used to determine the engine speed during that revolution). Use of multiple magnets spaced about the periphery of the flywheel can enhance the resolution of this determination by providing more data points in a revolution. Engine speed may also be determined by a sensor that is responsive to the position of the flywheel. Representative sensors including magnetically responsive sensors like hall-effect sensors or variable reluctance sensors. The flywheel may have teeth and the sensors may be responsive to the passing by of one or more teeth to determine flywheel position and hence, crankshaft position. The trigger coil 40 or a different coil in the ignition module may be used as a VR sensor as noted above.

Also shown in FIG. 2 is a timing sub-circuit 110 that permits a determination of the time since an engine was last operating, within a first threshold. The timing sub-circuit 110 includes an energy storage device 112 that is charged during operation of the engine to a threshold charge level which may be the maximum charge that can be stored on the device. The charge stored/energy level on the device 112 decays over time at a known rate when the engine is no longer operating. Thus, determination of the charge remaining on the device 112 at some time after the engine stopped operating permits determination of the time that has passed since the engine stopped operating.

This determined engine off time (i.e. the time since the engine stopped operating) along with one or more other factors may be used to determine an appropriate engine operating scheme that may include various engine operational control parameters, including but not limited to, one or more of richness of a fuel and air mixture to be delivered to the engine, ignition timing, desired engine idle speed among other engine operating conditions. Representative other factors that may be used in combination with the determined engine off time to refine the engine operating scheme/parameters to be used include, but are not limited to, one or both of the engine temperature and the ambient temperature. Such temperatures and the engine off time may be determined when the engine is restarted, or during attempted restarting of the engine. Different engine operational parameters may be used when the engine/ambient temperature is lower than when either or both temperatures are higher. Further, certain engine control parameters may be used when the engine has been stopped for greater than the first threshold time, as well as for different lengths of time within the first threshold time. In at least some implementations, an engine stopped for greater than the first threshold time may be operated as if the engine is being started from a cold or not recently operated condition. Conversely, an engine that very recently stopped operating, for example within a minute, may be restarted with the same engine operational control parameters that were used before the engine operation terminated, or with minimal change to one or more of such parameters.

In at least some implementations, the energy storage device is a capacitor 112 that is coupled to a regulated power supply such as the output 82 of the power supply sub-circuit 58, or Vcc/other supply voltage. To permit greater control over the charging of the capacitor 112, a switch 114 may be interposed in the circuit 110 including the capacitor and the capacitor may be charged when the switch is in a first state and is not charged when the switch is in a second state. Among other possibilities, the switch 114 may be in the second state when the engine is not operating, or otherwise when power is not provided to the switch, and may remain in the second state until after some threshold of engine operation is achieved and power is supplied to the switch. Thus, in at least some implementations, not all flywheel rotation results in charging of the capacitor 112. For example, initial rotation(s) of the flywheel/engine during attempted but failed starting attempts, or rotation of the engine during initial starting that is quickly followed by an engine stall, might not result in charging of the capacitor 112. Thus, such failed engine operating events do not add charge to the capacitor 112 which would interfere with or render inaccurate subsequent determination of the charge on the capacitor and subsequent determination of the time since the engine was last operated. That is, if all flywheel rotation resulted in charging of the capacitor 112, then repeated attempts to start the engine or the like would increase the charge on the capacitor 112 and make it seem as though the engine was running more recently than it actually was. By delaying charging of the capacitor 112 by leaving the switch 114 in its second state, the charge on the capacitor when the engine initially begins steady operation can be determined before additional charge is added to the capacitor to permit more accurate determination of the time since the engine was last operated, at least within the first threshold.

In at least some implementations, the switch 114 is coupled to the controller 56 and the controller provides power to the switch or otherwise actuates the switch from its second state to its first state. The controller 56 may require a certain energy level in the system before it is woken up and able to command the switch 114 and ignition circuit in general. Initial attempts to start the engine might not provide sufficient power to the controller 56 to render the controller operational, in which case, the controller cannot change the state of the switch 114. Thus, energy from the power supply coupled to the capacitor 112 is not automatically (that is, without intervention or control from the controller) communicated with the capacitor 112 during the initial attempts to start the engine. When the engine is operating and the controller 56 is sufficiently powered, the controller may determine the charge level of the capacitor 112 before changing the state of the switch 114 and allowing further charging of the capacitor. In this way, the charge on the capacitor 112 when determined by the controller 56 is representative of the time since the engine was last operating sufficiently to power the controller and permit charging of the capacitor 112.

In the implementation shown, the switch 114 is a MOSFET arranged between the power source and the capacitor 112; a diode 116 is coupled between the switch and capacitor to prevent reverse current flow from the capacitor through the switch, one or more resistors 118, 120, 122 may control the capacitor discharge rate and otherwise smooth out charging and discharging of the capacitor; and the timing subcircuit 110 is coupled to the controller at pins 3 and 5 to permit actuation of the switch (e.g. via power provided from pin 5) and determination of the charge on the capacitor 112 (e.g. at pin 3) when desired. Other switches and control schemes may be used.

The first threshold may be set to a desired level for a particular engine and/or engine application. In at least some implementations, the first threshold may be between 5 minutes and 45 minutes, although any limit within the determinable decay period for a capacitor or other energy storage device may be used. When the engine is off for a time greater than the first threshold, the engine may be operated as if the engine is cold/has not been operated recently, and may then be operated in accordance with any other desired factors, such as the engine temperature or ambient temperature without consideration for the time since the engine was last started. When the engine has been off for less than the first threshold amount of time, the time since the engine was last started may be included in process of selecting a desired engine control scheme or at least one engine operational parameter. While the operation is noted in terms of time, no actual "time" needs to be calculated. Instead, the decisions may be made as a function of the energy detected on the capacitor without correlating that energy level to a unit of time. The first threshold may then be a level of charge on the capacitor down to and including zero volts. That is, the first threshold need not be set to correspond to total discharge of the capacitor and could be set at a level between full charge and full discharge.

Thus, a method of operating an ignition system for a combustion engine may include a) charging an energy storage device during at least a portion of the time when the engine is operating, b) permitting the level of energy stored on the charge storage device to decrease over time after the engine ceases to operate, c) determining the energy level on the energy storage device when the engine is restarted after having ceased operating, and d) setting at least one engine operational parameter as a function of the determined energy level. A switch may be provided to control charging of the energy storage device. The switch has a first state in which charging of the energy storage device is not permitted and a second state in which charging of the energy storage device is permitted, and the switch is in the first state absent power being supplied to the switch. With such a switch, the method may include the step of providing power to the switch when the engine is operating so that the switch is in the second state and charging of the energy storage device is permitted. Then, charging of the energy storage device can be delayed until after the energy level on the device is determined. In at least some implementations, power is not provided to the switch until the engine has been operating for a threshold time or threshold number of engine revolutions.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A method of operating an ignition system for a combustion engine, comprising:

charging an energy storage device during at least a portion of the time when the engine is operating;

permitting the level of energy stored on the energy storage device to decrease over time after the engine ceases to operate;

determining the energy level on the energy storage device when the engine is restarted after having ceased operating; and setting at least one engine operational parameter as a function of the determined energy level; and comparing the energy level on the energy storage device when the engine is restarted after having ceased operating with information relating to the rate at which energy in the energy storage device decays over time.

2. The method of claim 1 wherein a switch is provided that has a first state in which charging of the energy storage device is not permitted and a second state in which charging of the energy storage device is permitted, the switch being in the first state absent power being supplied to the switch, and wherein the method includes the step of providing power to the switch when the engine is operating so that the switch is in the second state and charging of the energy storage device is permitted.

3. The method of claim 2 wherein power is not provided to the switch until the engine has been operating for a threshold time or threshold number of engine revolutions.

4. The method of claim 1 wherein the at least one engine operational parameter includes one or more of: richness of a fuel and air mixture to be delivered to the engine, ignition timing, desired engine idle speed.

5. The method of claim 1 which also includes determining one or both of engine temperature and ambient temperature and wherein the at least one engine operational parameter is set based in part on one or both of the determined engine temperature and ambient temperature.

6. The method of claim 5 wherein one or both of the engine temperature and ambient temperature are determined upon attempted restarting of the engine or when the engine has been restarted.

7. The method of claim 1 wherein, when the energy level in the energy storage device corresponds to the engine having been not operating for between 5 minutes and 45 minutes, at least one of richness of a fuel and air mixture to be delivered to the engine, ignition timing, and desired engine idle speed is set to a level equal to such level used when starting a cold engine.

8. The method of claim 7 wherein the energy level that corresponds to the engine having been not operating for between 5 minutes and 45 minutes is zero volts or more than zero volts.

9. A method of operating an ignition system for a combustion engine, comprising:

charging an energy storage device during at least a portion of the time when the engine is operating;

permitting the level of energy stored on the energy storage device to decrease over time after the engine ceases to operate;

determining the energy level on the energy storage device when the engine is restarted after having ceased operating; and setting at least one engine operational parameter as a function of the determined energy level, wherein a switch is provided that has a first state in which charging of the energy storage device is not permitted and a second state in which charging of the energy storage device is permitted, the switch being in the first state absent power being supplied to the switch, and wherein the method includes the step of providing power to the switch when the engine is operating so that the switch is in the second state and charging of the energy storage device is permitted, and wherein power is not provided to the switch until the energy level on the energy storage device, when the engine is restarted after having ceased operating, has been determined.

10. An engine control system, comprising:

a main energy storage device adapted to be communicated with an energy source;

an ignition switch coupled to the main energy storage device to control discharge of energy from the main energy storage device;

a timing circuit including a second energy storage device, a second switch coupled to the second energy storage device and having a first state permitting current flow to the second energy storage device and a second state that does not permit current flow to the second energy storage device; and a controller coupled to the second switch and to the second energy storage device, the controller being operable to control the state of the switch and to determine an energy level of the second energy storage device.

11. The system of claim 10 which also includes one or more resistors coupled between the second switch and the second energy storage device to at least in part control the discharge rate of energy from the second energy storage device.

12. The system of claim 10 wherein the main energy storage device is a capacitor.

13. The system of claim 10 wherein the second energy storage device is coupled to ground and energy discharged from the second energy storage device is discharged to ground.

* * * * *